United States Patent [19]

Conran et al.

[11] Patent Number: 4,901,893

[45] Date of Patent: Feb. 20, 1990

[54] DISPLAY DEVICE

[75] Inventors: Sebastian Conran; Antony Anderson, both of London, Great Britain

[73] Assignee: Marks and Spencer p.l.c., Great Britain

[21] Appl. No.: 229,332

[22] Filed: Aug. 5, 1988

[30] Foreign Application Priority Data

Aug. 7, 1987 [GB] United Kingdom ..... 8718737

[51] Int. Cl.[4] ..... A47F 7/22

[52] U.S. Cl. ..... 223/66; 223/92

[58] Field of Search ..... 223/37, 66, 71, 84, 223/85, 87, 92; 206/292, 293, 296, 297, 299, 492, 495; 53/117, 429

[56] References Cited

U.S. PATENT DOCUMENTS

| | | | |
|---|---|---|---|
| De. 136,082 | 8/1943 | Schreiber | 223/87 X |
| 2,326,685 | 8/1943 | Ruen | 223/87 |
| 2,387,681 | 10/1945 | Reed et al. | 223/87 |
| 2,448,673 | 9/1948 | Kohl | 223/87 |
| 3,252,565 | 5/1966 | Abbey | 223/87 X |
| 3,451,601 | 6/1969 | Pelavin et al. | 223/85 |
| 4,629,101 | 12/1986 | Franklin | 223/84 X |

FOREIGN PATENT DOCUMENTS

| | | | |
|---|---|---|---|
| 456287 | 3/1950 | Italy | 223/85 |
| 2192331 | 1/1988 | United Kingdom | 223/85 |

*Primary Examiner*—Werner H. Schroeder
*Assistant Examiner*—David K. Suto
*Attorney, Agent, or Firm*—Lerner, David, Littenberg, Krumholz & Mentlik

[57] ABSTRACT

A frame for holding and displaying articles of clothing comprises top bar (1), side bars (3) and bottom bar (4) with shorter internal bars (2) for location inside the shoulder regions of the garment. Each flat tab (6) near the respective upper portions of bars (3) can have a zigzag edge (7), and the bars (3) can themselves be zigzagged as at (5) for strength and to assist garment retention. Detachable spring polymer clips can fit onto the tab (6) to hold a lower edge of the folded garment. A suspension hook located by studs (17) and/or a polo-neck attachment fitted over bars (2) and (2*a*) can also be provided.

8 Claims, 8 Drawing Sheets

FIG.1.
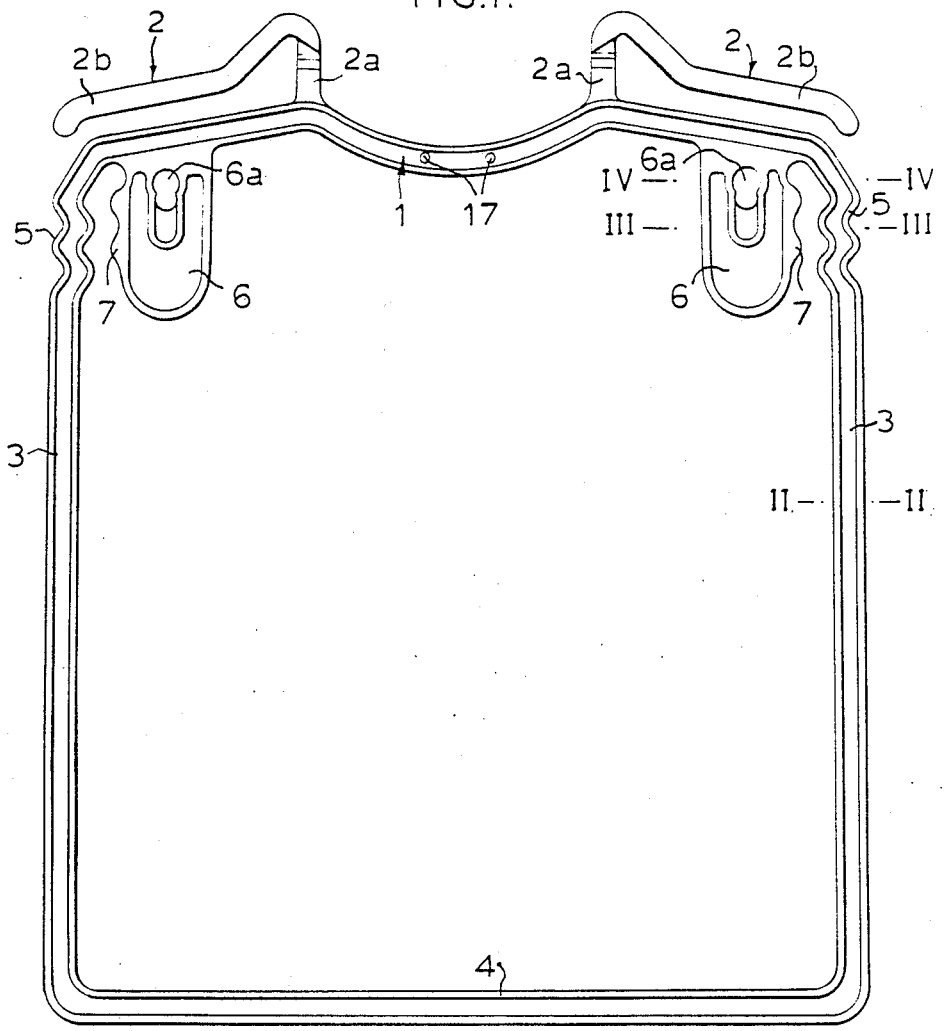
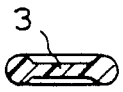
FIG.2.
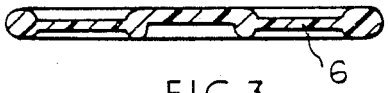
FIG.3.
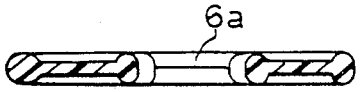
FIG.4.

DISPLAY DEVICE

BACKGROUND OF THE INVENTION

This invention relates to a display device for holding and displaying articles of clothing.

It is known to provide a display device especially suitable for the support and display of woollen garments such as sweaters or cardigans. The device has a first support element, usually a generally horizontal top bar, which passes across the shoulders of a garment at the top, outside of a neck aperture. It further possesses a pair of second support elements, typically two shorter bars, which pass through the neck aperture of the garment to locate one inside each shoulder zone. These are usually slightly offset, i.e. in a different plane, from the first bar. Finally, it possesses latch or clip means mounted on or adjacent the first support element, to receive and retain an upwardly folded lower edge. Optionally, all of the above structure can constitute the upper portion of a frame defining fold lines e.g. by means of a bottom bar or by optional additional bars, vertical or inclined, overr which sleeves may be folded.

The present invention relates generally to an improved version of such a device and to a clip assembly and other features adapted for use with such an improved version.

The known device involves generally transverse upper elements, and clips, all configured to provide a structure supportive of and capable of displaying the important neck and shoulder regions of garments, upon which device moreover the garment can be readily refolded and clipped after removal and trial. The improved features of the present invention in the various embodiments enhance the neck and shoulder support, and/or provide clips of improved appearance and function.

SUMMARY OF THE INVENTION

In one aspect therefore the invention consists in a display device suitable for support and display of garments, of the type comprising a first support element adapted to pass across the shoulders of the garment outside a neck aperture; a a pair of second support elements attached to the first support element and adapted to pass through the neck aperture of the garment and one inside each shoulder zone; and latch or clip means mounted on or adjacent to the first support element to receive and retain an upwardly folded lower region of the garment (hereinafter called "a display device of the type referred to") in which the latch or clip means includes two flat tab members extending from, and located one towards each end of, the first support element.

Such flattened tabs assist in supporting and defining the location of the shoulder regions in the folded garment.

In another aspect the invention consists of a display device of the type referred to comprising vertical side bars extending downwards each from one end of the first member (and optionally further including an integral bottom bar connecting the side bars) in which each bar has a transverse cross-sectional shape with enlarged rounded rigidifying edges.

By this expedient the device can be made light in weight without loss of strength.

The bars can have edges with a zig-zag configuration at their upper regions near the first support member.

Again this provides strength against buckling or twisting at a crucial point. Also, the edge of any flattened tab member nearest the said upper regions can be zigzagged for appearance or so as to define a retaining space of zig-zag shape for holding edge regions of the lower portion of the garment when folded up.

It will be appreciated therefore that the invention extends both to the separate provision of tabs and of side bars configured as described, and to their joint and interacting provision.

The tabs themselves may be configured as clips or latches. More preferably, however, they each constitute a support to which a separate clip or latch is attached, e.g. by a non-return press member pushed through a hole in the tab. The device as defined above including attached clips or latches is thus a further aspect of the invention, as are the clips or latches per se.

A preferred form of clip comprises an integral synthetic polymeric moulding of two flat jaws provided with gripping configurations or adaptations upon mutually opposed faces and with an integral spring means external to the jaws, acting to force them into engagement. Possibly, the spring means has two stable positions whereby the jaws are held open at a wide angle of separation until manually pushed beyond a limit position at which the spring biasses the pairs to close.

In one form the clip comprises, as an integral synthetic polymeric moulding, (a) a first flat jaw with horizontal gripping serrations;

(b) a second flat jaw with complementary horizontal gripping serrations, moulded to extend normally at a large angle to the first jaw, and possessing a fold line across a rear face;

(c) an integral spring generally U-shaped in cross-section with one limb either side of the fold line, at the rear face;

the configuration being such that the second jaw folds with its fold line located within the U-shape of the spring whereby a retaining force is provided at the opposed serrated faces.

The rear face of the first jaw can possess a stud which presses non-removably into a suitable hole in a tab of the display device. Conveniently, therefore, the clip and the tab have similar peripheral configurations.

In yet another aspectt the invention consists of a display device of the type referred to in further combination with a central clip for a suspension hook, the clip being configured to locate between indicator members spaced to either side of the mid-point of said first member and thereby suspend the device. Preferably the said clip has an outwardly and upwardly projecting tongue spaced from a main body portion by an amount to accommodate said first member, optionally beneath non-return lug formations projecting from said body portion.

In yet another aspect the invention consists of the combination of a display device of the type referred to and a polo neck attachment bridging the central space between the two second support elements and configured to display a polo neck configuration. Preferably said attachment is a bar with downwardly projecting end tongues to fit within the double polo neck fabric and downwardly open fixing clips each comprising a front and back wall spaced by an amount to locate securely over an uppermost portion of the second support members.

The invention will be further described with reference to the accompanying drawings in which:

BRIEF DESCRIPTION OF THE DRAWINGS

FIG. 1 is a plan view of one embodiment of a display device in accordance with the present invention;

FIG. 2 is a section on II—II of FIG. 1;

FIG. 3 is a section on III—III of FIG. 1;

FIG. 4 is a section on IV—IV of FIG. 1;

DETAILED DESCRIPTION OF THE PREFERRED EMBODIMENTS

Figure 5:
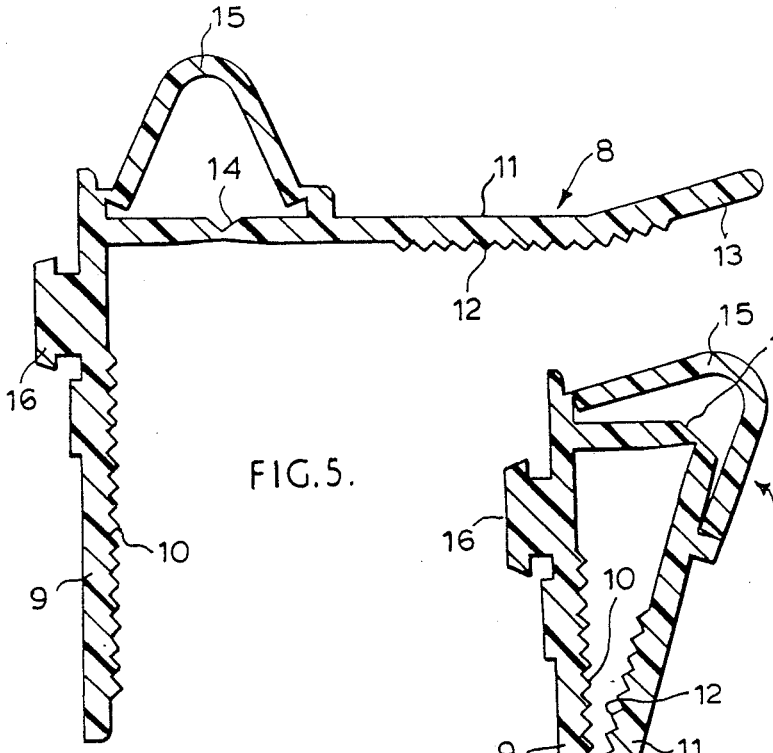
FIG. 5 is a vertical section through a clip for use with the display device, in open condition.

The display device of FIG. 1 is an integral moulded polymer frame. It has a first support member constituted by top cross bar 1, and second support members constituted by bars 2, each of which rises at 2*a* vertically above bar 1 and is then configured out of the plane (i.e. above the plane of the drawing) as an outwardly extending piece 2*b*. In a major mode of use, the frame is turned over from the position shown in the drawing and laid on a sweater (for example) with pieces 2*b* extending inside the neck aperture and beneath the shoulders, and the frame is always configured to permit such use on such garments.

The frame has side bars 3 and bottom bar 4. Each side bar 3 has a zig-zag edge configuration in an upper region at 5, near where it meets the top bar 1. Near each zig-zag configurations 5 is a flat tab 6, with its outer edge 7 also complementarily zig-zagged. The tab 6 has a through hole 6*a*.

Side bars 3, bottom bars 4 and tabs 6 are all generally flat and co-planar with rounded edges as a stiffening expedient, as shown in FIGS. 2, 3 and 4.

Figure 6:
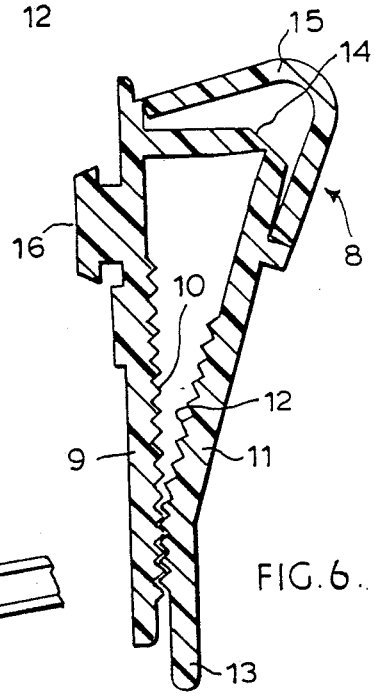
FIG. 6 is a vertical section through the clip when closed.

FIGS. 5 and 6 show in vertical cross-section the open and closed configuration of a clip 8 for mounting on tabs 6.

The clip, which is also an integral polymer structure, comprises a first jaw 9 with horizontal gripping serrations or ribs 10, and a second jaw 11 with like ribs 12 and optionally a slightly angled end 13 to help re-opening once closed. Second jaw 11 has a fold line or channel 4 across the back. Bridging this fold line is an integral spring 15, generally U-shaped in cross-section with one limb of the U to each side of the fold line 14.

Upon the rear face of jaw 9 is a stud 16, of tapered cross-section.

Figure 7:
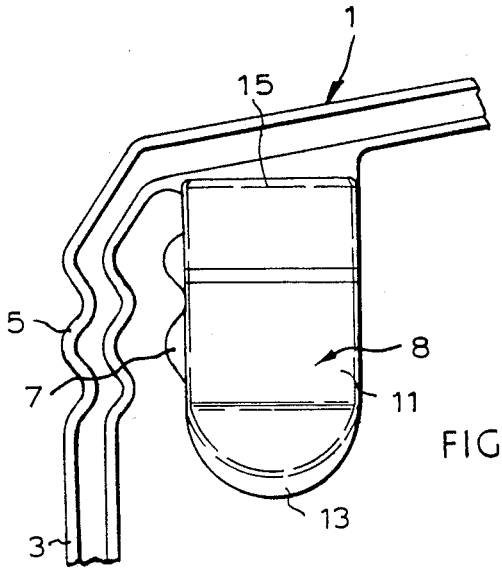
FIG. 7 shows the location and appearance of the clip attached to the frame of the display device of FIG. 1.

The periphery of the clip 8 is shown in FIG. 7, which also shows its mode and location of assembly. Stud 16 is pushed through hole 6*a* in tab 6, as a permanent assembly. Thus, in use, when a garment is placed on the frame as described above, and its lower edge folded upwards, the lower edge can be placed upon serrations 10 of jaw 9 and the jaw 11 can be pushed downwards, out of its stable configuration of FIG. 5, to snap into its other stable configuration, of FIG. 6, with the fold line 14 inside the U-shape of the spring and the garment suitably gripped.

FIG. 7 shows the neat and safe appearance of the assembly. Moreover, if desired, the edge of the lower portion of the garment can be tucked into the zig-zag channel defined between the tab edge 7 and zig-zag edge of upper portions 5. Thus, the zig-zag shape can have a tidying and retaining function as well as its anti-buckling and anti-torsion rigidifying effects.

The display device shown in the preceding drawings, along with clip, is primarily intended as a frame to lie on a counter or like display. However, it is possible to embody the device to facilitate attachment of a hook clip whereby a hook can be located at the top centre position and the garment hung up.

Figure 8:
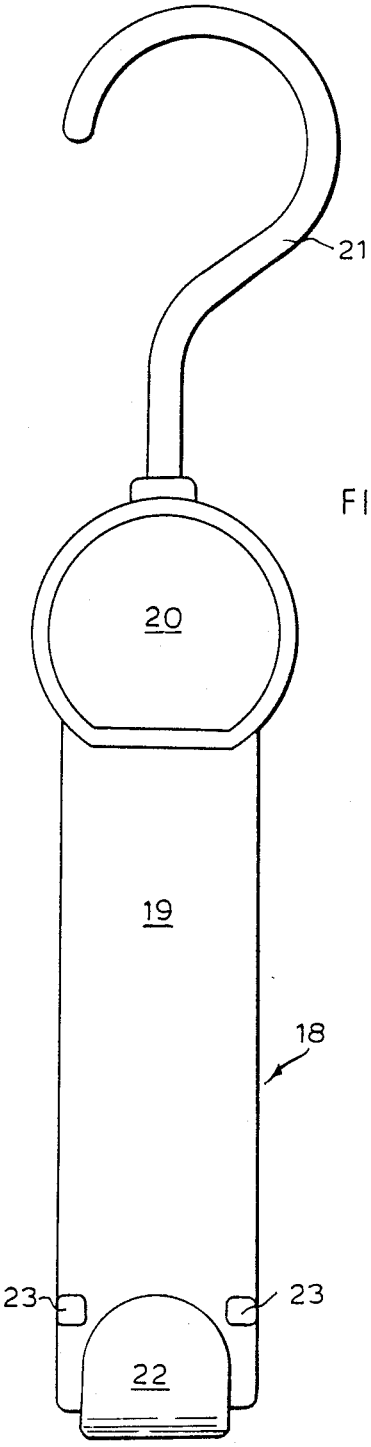
FIG. 8 is a front view of a hook clip for optional use with the display device as shown in FIGS. 1 to 4.
Figure 9:
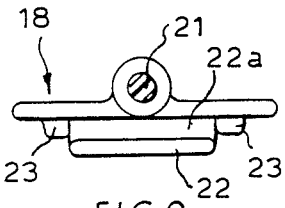
FIG. 9 is a top view of the hook clip of FIG. 8, without the hook.
Figure 10:
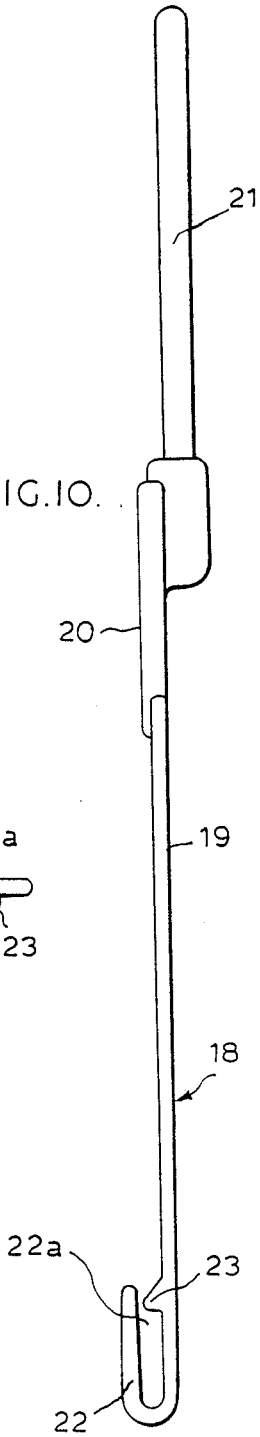
FIG. 10 is a side view of the hook clip of FIG. 8.

Inspection of FIG. 1 will show two studs 17 equispaced about the centre of the top bar 1. FIG. 8 shows in front view a hook clip 18 (on an enlarged scale) which fits between these locating studs to carry an uppermost hook, not itself shown in detail for convenience in illustration.

Hook clip 18 is an integral polymeric structure. It has a flat rectangular body 19, and a top size-tab location 20 to which hook 21 is secured. At its lower end there is an integral tongue 22, somewhat narrower than the body 19, extending forwardly then upwardly parallel to the body 19. The spacing 22*a* between tongue 22 and body 19 is such as to receive and grip the flattened bar 1. Side lugs 23, sloping outwardly on their upper faces, form non-return retaining stops for the bar 1 once this bar is assembled into spacing 22*a*, at a central location as defined by the studs 17 on bar 1.

As indicated above, the display device of the present invention folds and displays bulky articles such as sweaters to best advantage. It moreover provides a particularly advantageous basic framework upon which can be attached a "polo neck" attachment for further enhancing the display of such articles.

A "polo neck" is a flexible, usually knitted, tube of fabric at the neck of a garment, which in use is rolled down to form a neat circular band around the neck of the wearer. To support and display such garments additional structure is preferably at the central neck region of the device shown in FIG. 1.

Figure 11:
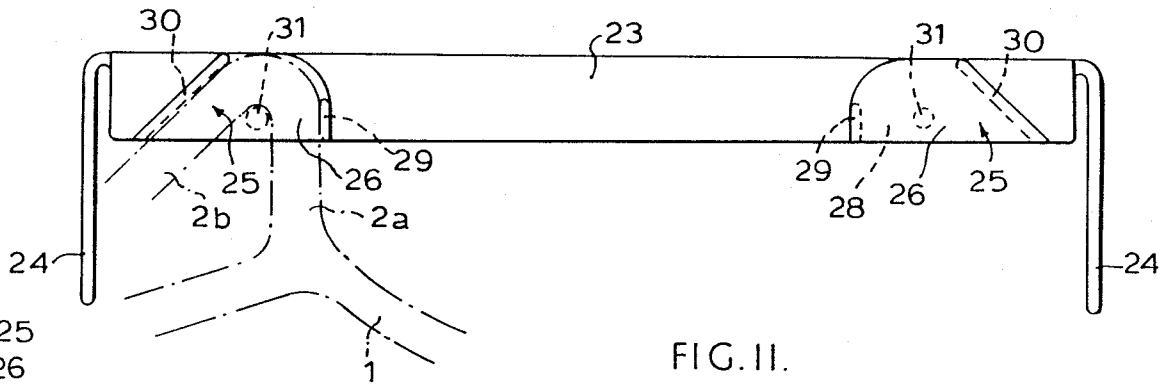
FIG. 11 is a back view of a polo neck attachment for optional use with the display device as shown in FIGS. 1 to 4.
Figure 12:
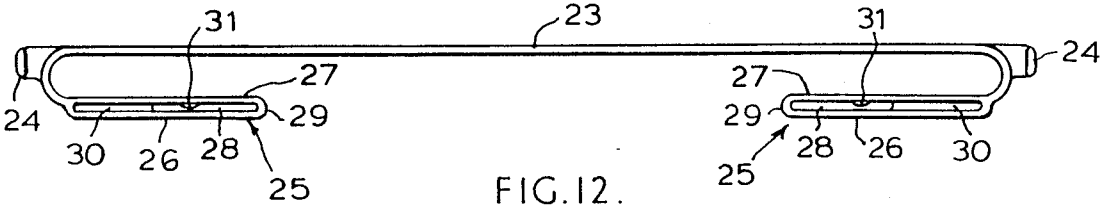
FIG. 12 is a bottom view of the attachment of FIG. 11.
Figure 13:
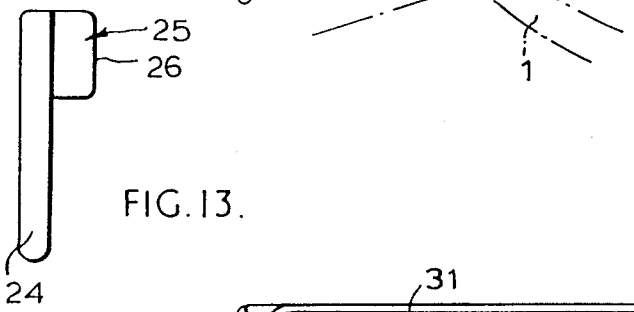
FIG. 13 is a side view of the attachment of FIG. 11.

FIGS. 11, 12 and 13 show such a structure which is essentially a bridge between the upper ends of rising portions 2*a*, where they meet the outer pieces 2*b* of the second support members 2. It comprises a cross-bar 23, somewhat flexible downwardly projecting members 24, and shaped fixing clips 25, each of which has a front and back wall (26 and 27 respectively) spaced to receive the curved transition between portions 2*a* and 2*b*. Within the gap 28 between the walls 26 and 27 is a locating end wall 29, a sloping top wall 30 (to overlie the upper sloping contour of outer piece 2*b*) and a rounded retaining stud 31 to fit beneatch the upper part of member 2, where 2*a* and 2*b* meet.

FIGS. 14 to 21 show the folding of a polo neck sweater, it being understood that folding of other forms of garment will adopt some of the steps described.

Figure 14:
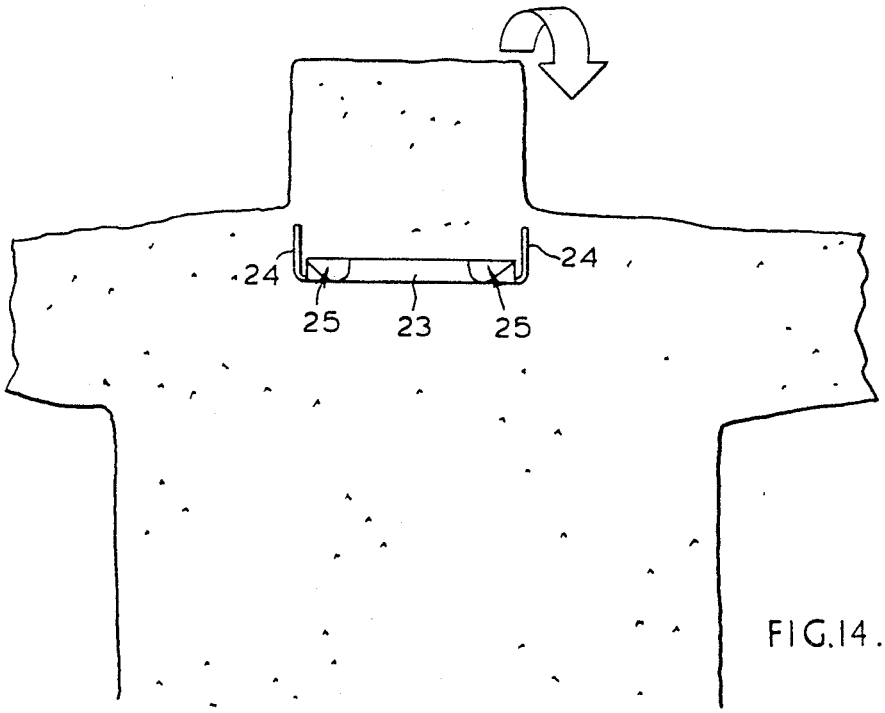
FIGS. 14 to 21 show successive stages in folding a garment using as example a polo neck garment and the optional attachment of FIGS. 11 to 13.

FIG. 14 shows the polo necked sweater laid flat facing the folding operative. The neck is rolled down and flattened and the bridge piece of FIGS. 11 to 15 is placed upside down and facing the operative to locate the arms 24 within the area of the neck.

Figure 15:
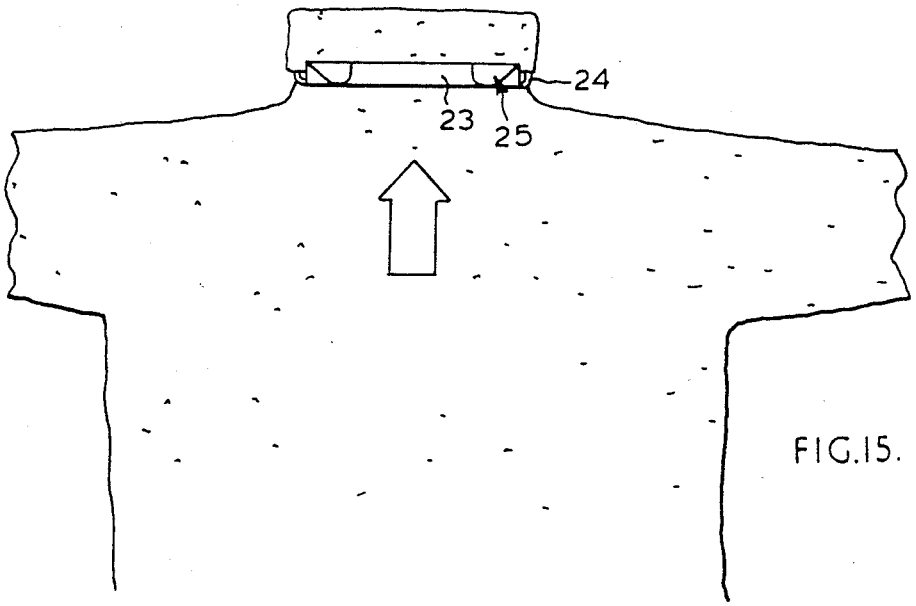

FIG. 15 shows the ensuing structure.

Figure 16:
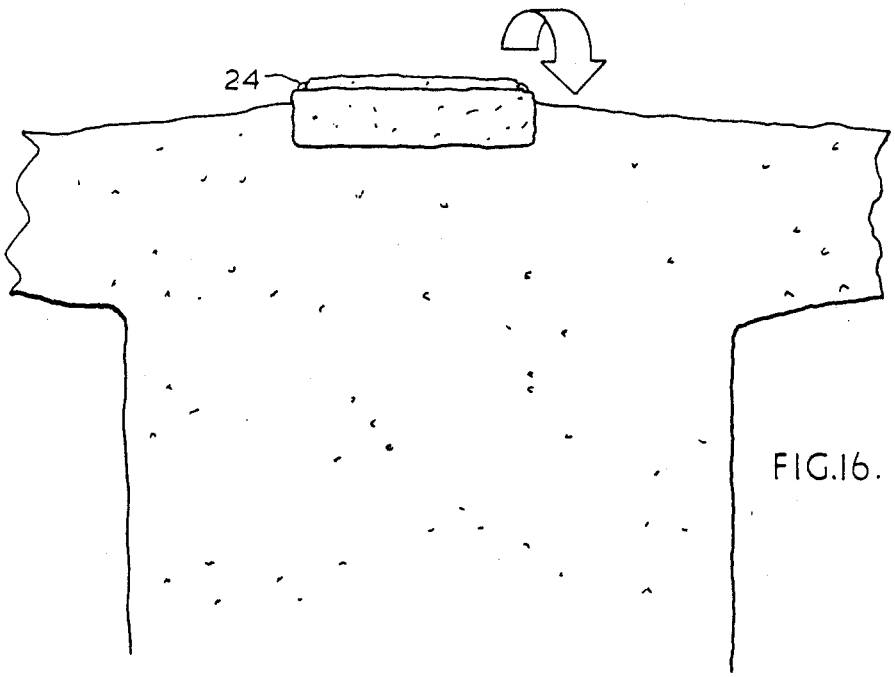
Figure 17:
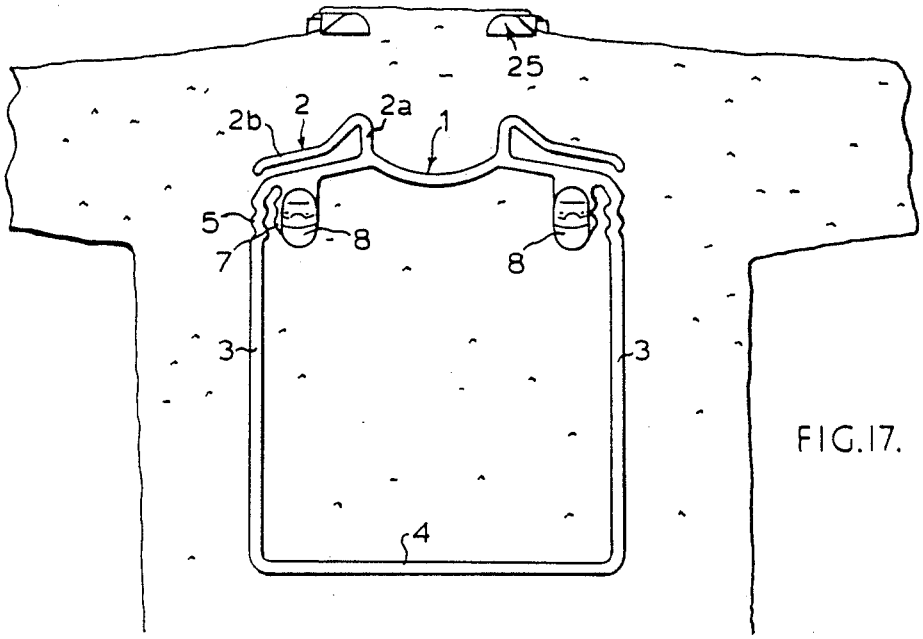

FIG. 16 shows the sweater of FIG. 15 turned over and with the neck portion then simply folded back so that the back view, FIG. 17, now exhibits clips 25 in a position to receive the upper contour *2a, 2b* of the device shown in FIGS. 1 to 4.

Figure 18:
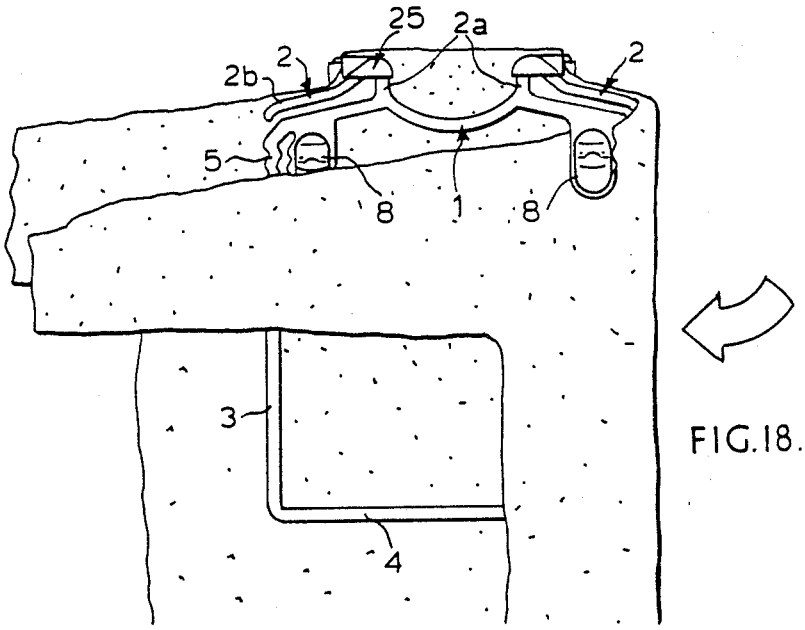
Figure 19:
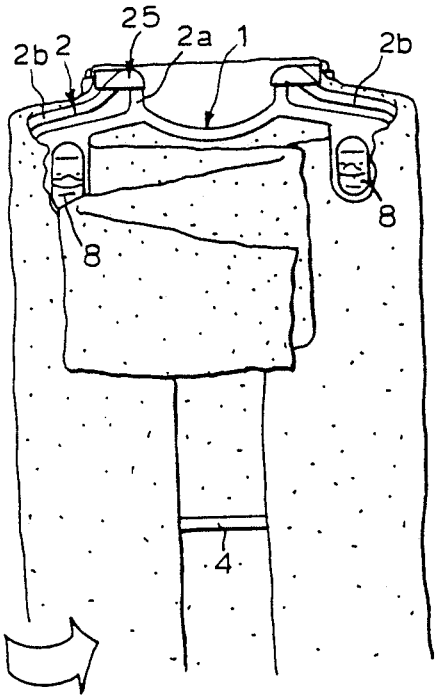
Figure 20:
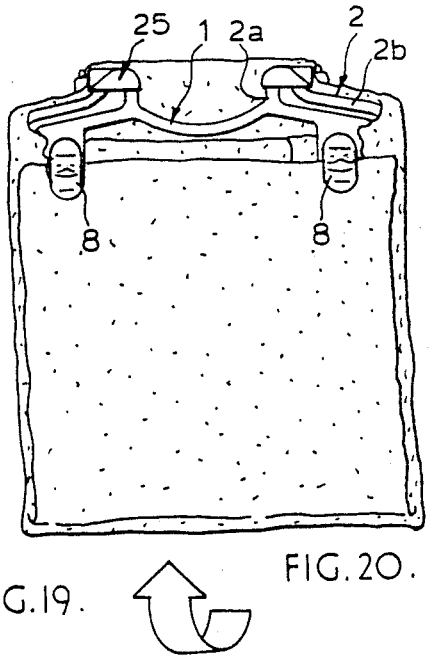

When frame 1 is pressed up into the clips 25, between walls 26 and 27, the result looks generally as shown in FIGS. 18 to 20. At this stage an arm, and a portion of one side, of the garment can be folded over the side bars 3 and into the zig-zag space between the shaped edges 5 and 7. The other arm can also be folded in at the other side, again beneath clip tab 6 as shown in FIG. 19. Finally, the bottom region is folded up as shown in FIG. 20 and held in jaws 8 as described above.

Figure 21:
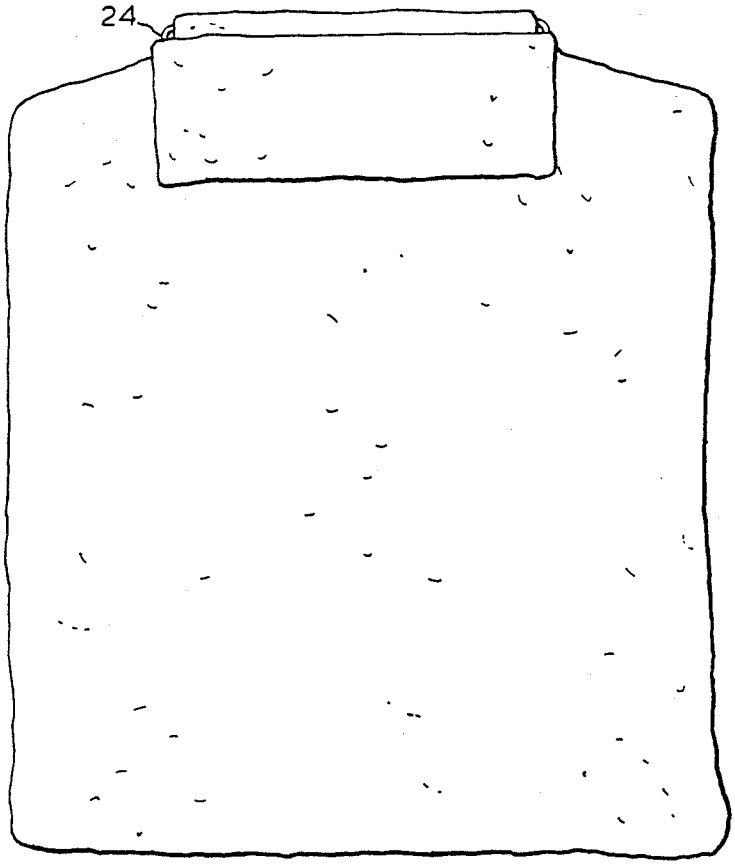

From the front the sweater has the neat appearance as shown in FIG. 21.

It is to be noted that the present invention, in utilising one frame with a variety of clip-on units, permits different polymers to be used, e.g., a rigid polymer such as polystyrene for the rigid frame but a more flexible polymer such as polypropylene for the hinged clips and like units.

Moreover, while the "display device of the type referred to" as defined herein has second support elements adapted to pass inside the neck, such support elements need not be used in this function and indeed are not so used in "polo neck" adaptation. Nevertheless they still possess a generally rigidifying and supportive structure at the neck and shoulders region.

We claim:

1. A display device suitable for the support and display of a garment having a neck aperture and first and second shoulder portions comprising, a first support element adapted to pass across said first and second shoulder portions of said garment outside said neck aperture, said first support element having a first end and a second end, first and second auxiliary support elements attached to said first support element and adapted to pass through said neck aperture of said garment, said first auxiliary support element adapted to be located inside said first shoulder portion and said second auxiliary support element adapted to be located inside said second shoulder portion, at least two vertical side bars each having a transverse cross-sectional shape with enlarged rounded rigidifying edges, one of said vertical side bars extending downward from said first end of said first support element and said other of said vertical side bars extending downward from said second end of said first support element, at least two flat tab members, each of said tab members extending downward from said first support element adjacent to one of said vertical side bars, and having a first edge proximate to said adjacent one of said vertical side bars, and clip means separably connected to said tab members to receive and retain an upwardly folded lower portion of said garment.

2. A display device as claimed in claim 1 wherein an upper portion of each of said vertical side bars has a zigzag configuration in a plane parallel to said first support element.

3. A display device as claimed in claim 1 wherein said first edges of said tab members have a zigzag configuration in a plane parallel to said first support element.

4. A display device as claimed in claim 1 wherein said clip means include two flat jaw members having mutually opposable faces, gripping means formed on each of said opposable faces and spring means external to said jaw members and acting to force said opposable faces into engagment with one another.

5. A display device as claimed in claim 4 wherein said clip means include stud means for removable insertion into aperture means in said tab members.

6. A display device as claimed in claim 6 further comprising suspension means adapted for attachment to said first support element so that said display device may be suspended from a support structure, said suspension means including a flat, elongated body portion having a top end and a bottom end, and an upwardly projecting tongue member at said bottom end of said body portion, said tongue member being spaced from said body portion to allow the insertion of said first support element therebetween.

7. A display device as claimed in claim 6 wherein said first support element includes locater means to locate said suspension means at the midpoint of said first support element.

8. A display device as claimed in claim 8 further comprising neck attachment means connectable between said first and second auxiliary support elements, and adapted to display a polo-neck configuration on said garment, said neck attachment means including bar means having a first end and a second end, tongue means extending downward from said first and second ends of said bar means and adapted for insertion into said polo-neck configuration, and fixing clip means connected in spaced relation with said bar means and adapted for connection with said first and second auxiliary support elements.

* * * * *

UNITED STATES PATENT AND TRADEMARK OFFICE

CERTIFICATE OF CORRECTION

PATENT NO. : 4,901,893

DATED : February 20, 1990

INVENTOR(S) : Conran et al

It is certified that error appears in the above-identified patent and that said Letters Patent is hereby corrected as shown below:

Column 6, line 29, "claim 6" should read --claim 1--.

Column 6, line 44, "claim 8" should read --claim 1--.

Signed and Sealed this

Fourteenth Day of May, 1991

*Attest:*

HARRY F. MANBECK, JR.

*Attesting Officer*

*Commissioner of Patents and Trademarks*